United States Patent [19]

Grollimund

[11] Patent Number: 4,582,507

[45] Date of Patent: Apr. 15, 1986

[54] APPARATUS FOR MANUFACTURING AN EXPANDED WEB OF SHEET MATERIAL AND A COMPOSITE EXPANDED WEB

[75] Inventor: Everett C. Grollimund, Midlothian, Va.

[73] Assignee: Philip Morris Incorporated, New York, N.Y.

[21] Appl. No.: 613,160

[22] Filed: May 23, 1984

[51] Int. Cl.[4] ..... B31D 1/00

[52] U.S. Cl. ..... 493/381; 156/197; 493/42; 493/966

[58] Field of Search ..... 493/42, 381, 966, 463; 156/197

[56] References Cited

U.S. PATENT DOCUMENTS

| | | | |
|---|---|---|---|
| 1,103,033 | 7/1914 | Clark . | |
| 1,389,294 | 8/1921 | Dean . | |
| 2,581,421 | 8/1952 | Lombard et al. . | |
| 2,670,314 | 2/1954 | Ungar . | |
| 2,940,891 | 6/1960 | Muller . | |
| 2,981,261 | 4/1961 | Rupert . | |
| 3,044,921 | 7/1962 | Wentworth et al. . | |
| 3,518,921 | 7/1970 | Muller . | |
| 3,538,210 | 11/1970 | Gatto . | |
| 3,887,418 | 6/1975 | Jurisich | 156/197 |
| 4,047,536 | 9/1977 | Asfour . | |
| 4,274,428 | 6/1981 | Muller et al. | 493/42 |
| 4,283,186 | 8/1981 | Keith et al. . | |

FOREIGN PATENT DOCUMENTS

| | | | |
|---|---|---|---|
| 1045783 | 12/1958 | Fed. Rep. of Germany | 493/966 |
| 2232829 | 2/1973 | Fed. Rep. of Germany | 493/966 |
| 2310300 | 1/1977 | France | 493/463 |
| 1277449 | 6/1972 | United Kingdom . | |

*Primary Examiner*—W. D. Bray

*Attorney, Agent, or Firm*—Thomas L. Secrest

[57] ABSTRACT

An apparatus having rotary shearing and forming dies which expand a web of formable material by imparting to the web a surface configuration having rows of generally sinusoidal convolutions extending longitudinally along the web, each row lying 180° out of phase from abutting rows. The meshing rotary dies include flat portions defining a neutral zone wherein no web deformation occurs, with the result that each convolution in a row is joined to the next longitudinally succeeding convolution by a flat web section lying in the original plane of the formable sheet material. The expanded web is laminated to a flat web of paper-like material and the resulting composite web is converted to expanded cigarette wrappers.

9 Claims, 17 Drawing Figures

APPARATUS FOR MANUFACTURING AN EXPANDED WEB OF SHEET MATERIAL AND A COMPOSITE EXPANDED WEB

FIELD OF THE INVENTION

This invention relates to apparatus for manufacturing an expanded web and a composite web. Such webs are particularly useful for forming expanded cigarette wrappers. More particularly, this invention relates to an apparatus, capable of employment directly on line with a cigarette making machine, in which a web of relatively stiff sheet material is expanded and attached to a second web of paper-like material to form a composite web, which is then used to make expanded cigarette wrappers. While such webs are particularly suitable for use in making cigarette wrappers, the apparatus herein is broadly adaptable for use in making webs for a variety of applications.

BACKGROUND OF THE INVENTION

Expanded cigarette wrappers are useful in the mass production of cigarettes because they allow for the manufacture of cigarettes whose firmness is largely independent of tobacco rod density. Examples of expanded wrappers are disclosed and claimed in U.S. applications Ser. No. 592,070 and Ser. No. 592,063), both filed on Mar. 22, 1984 and commonly assigned herewith, and in my co-pending U.S. application Ser. No. 613,159, the disclosure of which is fully incorporated herein by reference. The apparatus of this invention is particularly adapted to the manufacture of expanded and composite webs as disclosed and claimed in my co-pending application.

SUMMARY OF THE INVENTION

The apparatus of this invention expands a web of sheet material by shearing and forming it between rotary dies to create on the web a textured pattern of generally sinusoidal convolutions projecting above and below the original plane of the web. The expanded web then may be attached to a second web of paper-like material to form a composite web. The second web forms the outer wrap of an expanded cigarette wrapper when the composite web is converted to expanded wrappers by conventional means.

It is an object of this invention to provide an apparatus for high speed manufacture of an expanded web of sheet material.

It is also an object of this invention to provide an apparatus for manufacturing a composite web of expanded and unexpanded sheet material.

It is another object of this invention to provide an apparatus for manufacturing a composite web, which apparatus for manufacturing a composite web, which apparatus is capable of employment directly on line with a cigarette making machine.

It is a further object of this invention to provide an apparatus for manufacturing a composite web having adjustable longitudinal gas permeability.

These and other objects of the invention may be appreciated from the following description taken in conjunction with the drawings.

BRIEF DESCRIPTION OF THE DRAWINGS

FIG. 2 is a partial plan view of the rotary shearing and forming dies of the invention.

DETAILED DESCRIPTION OF THE PREFERRED EMBODIMENT

Figures 8, 14:
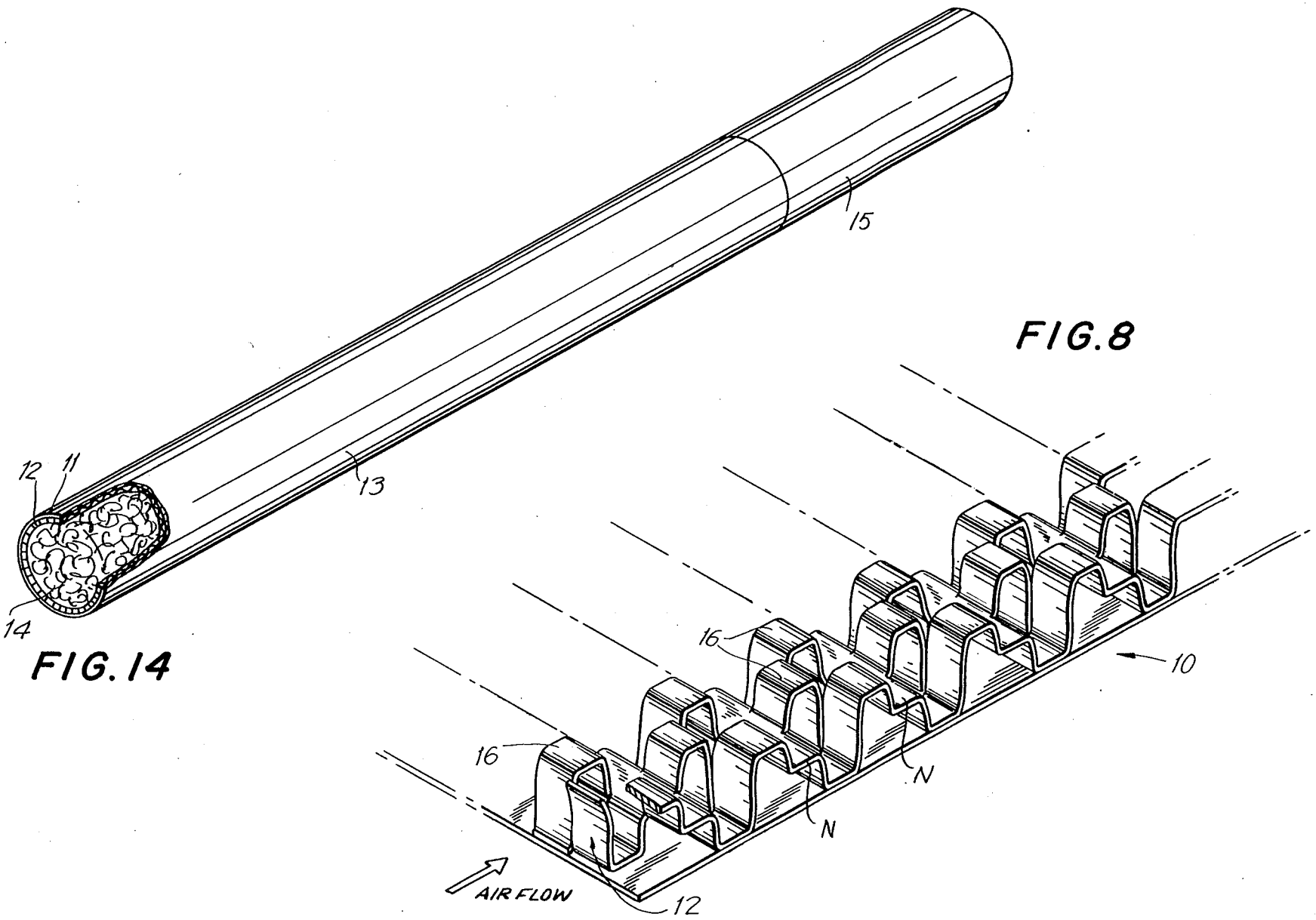
FIG. 8 is a perspective view of the composite web manufactured by the apparatus of the invention.
FIG. 14 is a perspective view of a cigarette employing an expanded wrapper formed from a composite web manufactured by the apparatus of the invention.
Figure 9:
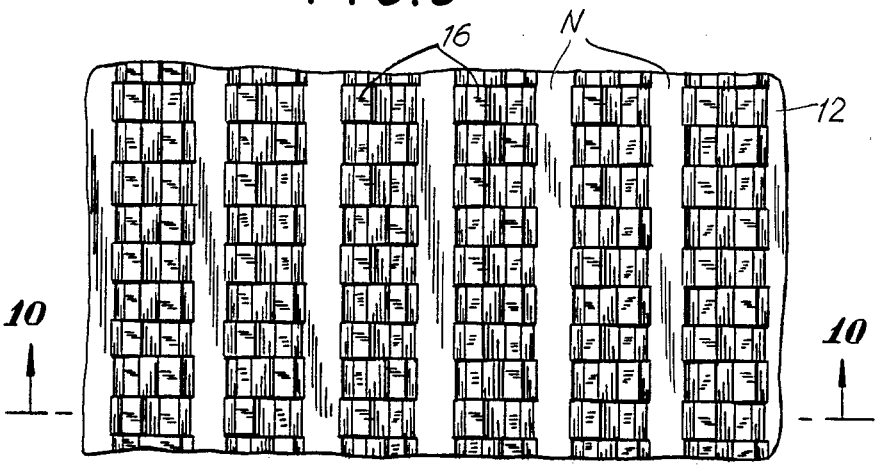
FIG. 9 is a plan view of the expanded web manufactured by the apparatus of the invention.
Figure 10:
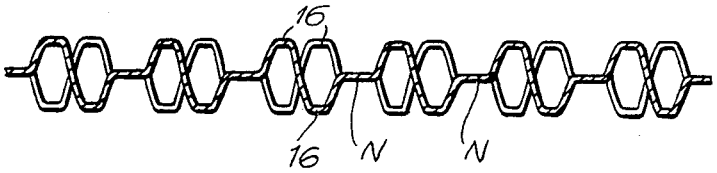
FIG. 10 is a sectional view of the expanded web taken along line 10—10 of FIG. 9.
Figure 15:
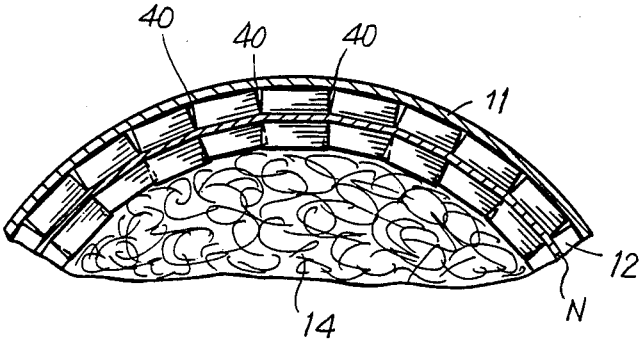
FIG. 15 is a partial sectional view of the cigarette of FIG. 14.

The apparatus of this invention produces a composite web 10 (FIG. 8) suitable for incorporation into a cigarette as an expanded wrapper 13 when curled around its longitudinal axis to encircle a tobacco rod 14 (FIG. 14). The wrapped tobacco rod 14 may be joined to filter 15 by known means. Composite web 10 comprises an outer layer of paper-like material 11 attached to a surface of expanded web 12. The expanded web 12 is characterized by generally sinusodial convolutions 16 which extend across the width of web 12 and run longitudinally down the web length.

Figure 1:
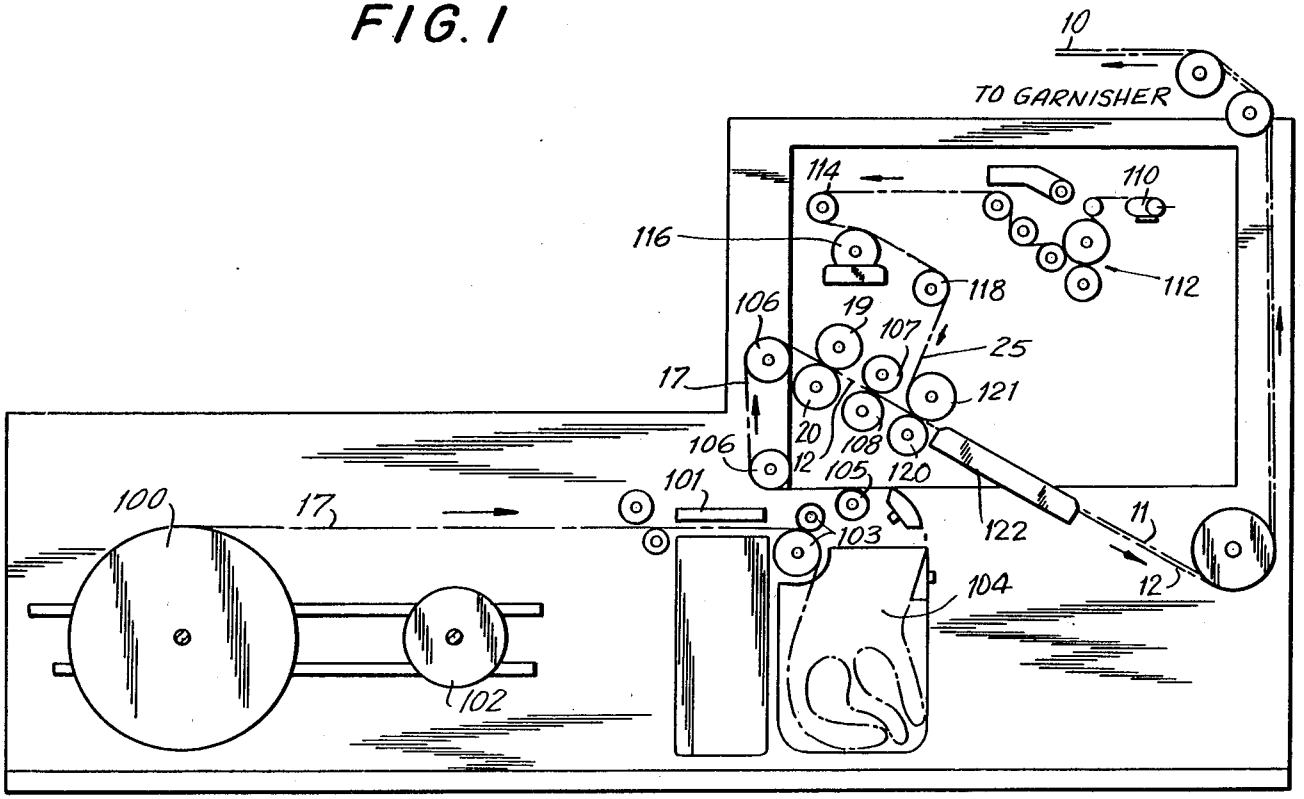
FIG. 1 is a schematic view of the apparatus of this invention.

The apparatus of this invention may be applied to a conventional cigarette making machine, such as a Molins Mark 9-5 machine, as illustrated in FIG. 1. The apparatus generally comprises a bobbin 100 of formable sheet material 17 to be formed into expanded web 12. Web 17 passes through conventional splicer 101 where material from alternate bobbin hub 102 may be spliced to web 17 in known fashion. Pinch rollers 103 pull web 17 off of bobbin 100 and feed the web into accumulator 104, from where web 17 is drawn around idler wheels 105 and 106 and through rotary shearing and forming dies 19 and 20. Shearing and forming dies 19 and 20 act on web 17 to form expanded web 12 in a manner discussed more fully below in conjunction with FIG. 2.

After shearing and forming, expanded web 12 is metered through accumulator wheels 107 and 108 and fed onto web 25, which will become outer wrapper 11 in expanded wrapper 13. Web 25 is drawn from a known cigarette wrapper feed assembly (not shown) preferably located parallel to and slightly off-line from the apparatus of the invention. The web 25 is brought on line with expanded web 12 by passage around two 45° rollers in known manner. The second 45° roller is illustrated at 110. From roller 110, web 25 passes through printing station 112 where it is printed in known fashion with desired decorations or brand marks.

After printing web 25 passes around idler wheel 114 to glue wheel 116 where glue line 24 is applied longitudinally down the center line of the surface of web 25 which will confront expanded web 12. Web 25 is then passed around idler 118 to nip rollers 120 and 121 where it confronts and is urged against the surface of expanded web 12. From nip rollers 120 and 121, the now composite web 10 passes through dryer 122 where glue line 24 is set for a secure bonding of the laminated structure. After drying of glue line 24, composite web 10 is transferred in known fashion to the garnisher of a cigarette making machine where the web is curled about its longitudinal axis for receipt of tobacco or other cigarette filler by conventional cigarette making means. Alternatively, the webs may be laminated in confronting relationship without gluing and thereafter may be guided together to the garnisher.

Figure 2:
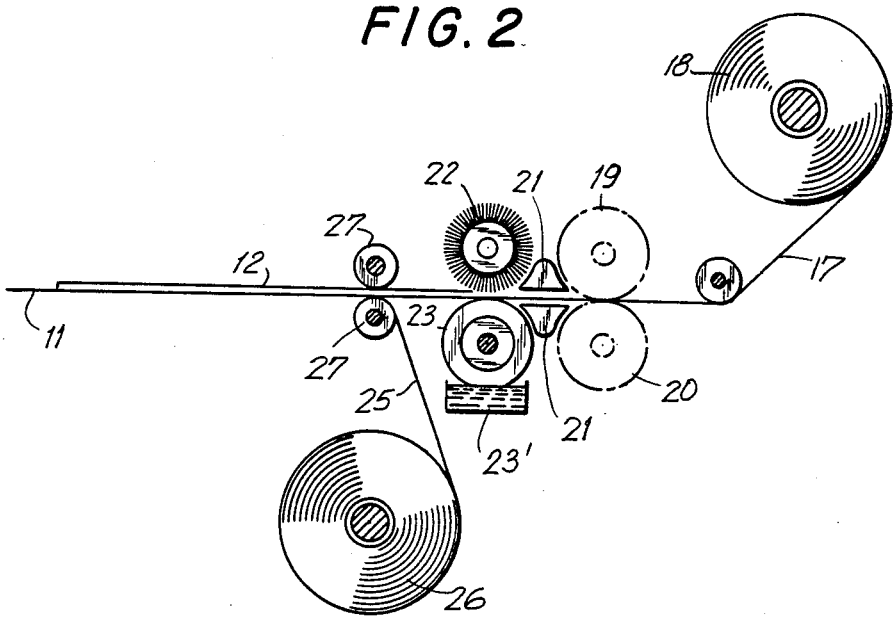
FIG. 2 is a partial schematic view of an alternate arrangement of the apparatus of this invention.
Figure 3:
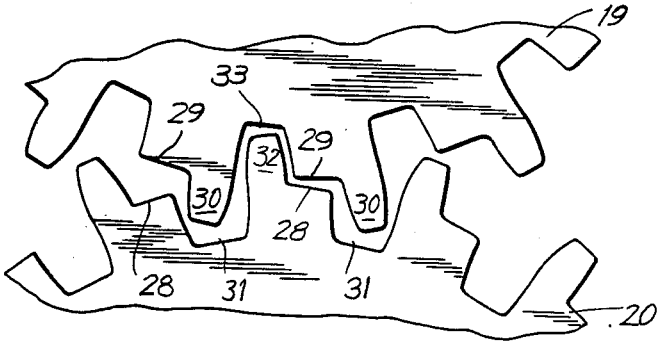

FIG. 2 schematically illustrates the station of the apparatus where web 17 is formed into expanded web 12. It also shows an alternate configuration wherein glue wheel 23 applies glue line 24 to the surface of expanded web 12 rather than to web 25. In this configuration glue wheel 23 acts with accumulator wheel 22 to form a nip for controlling the feed of expanded web 12 onto web 25. Otherwise, the operation of the web expansion apparatus depicted in FIG. 2 is substantially the same as that of FIG. 1, and the embodiment shown in FIG. 2 will be used to describe the operation of the web expansion station.

In the apparatus, sets of meshing rotary shearing and forming dies 19 and 20 receive a web of formable sheet material 17 from bobbin 18 (corresponding to bobbin 100 in FIG. 1) and convert it to expanded web 12. Expanded web 12 is then attached to web 25, which will provide outer wrap 11 when composite web 10 is converted into wrapper 13 for an individual cigarette.

Die sets 19 and 20 are preferably rotary meshing shearing and forming dies disposed in meshing pairs across the width of web 17. Each set of dies 19 and 20 is composed of a plurality of die pairs each die pair being made up of die elements A & B and C & D.

Figure 4:
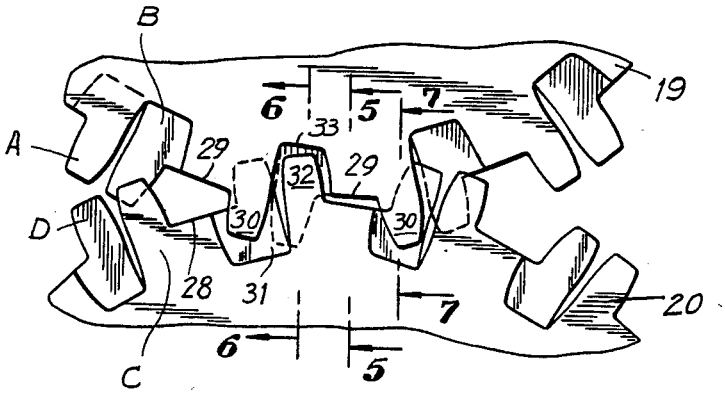
FIG. 4 is a plan view of two pairs of rotary shearing and forming dies.

In each die pair, an "A" die is offset 180° out of phase from a "B" die (FIG. 4), so that alternating rows of convolutions extending above and below the plane of web 17 are created. Each "A" or "B" die meshes with a corresponding "C" or "D" die to shear and form web 17 as it traverses dies 19 and 20. The meshing faces of the dies are shaped in a generally sinusoidal pattern with each complete tooth being joined to the next contiguous recess by a flat portion of the die. Dies 19 and 20 are positioned so that each generally sinusoidal tooth 30 meshes with a corresponding recess 31 and so that flat portions 28 and 29 align during rotation to create a neutral zone "N" in which no web formation or shearing occurs.

The clearance between the die set pairs preferably equals the thickness of web 17 so that there is no compression of the web. As the dies rotate both 30 meshes with recess 31 and forms web 17 into the lower half of the generally sinusoidal convolution. Further rotation of the dies meshes tooth 32 with recess 33 and so generates the upper half of the convolution. Further rotation of the dies brings together flat portions 28 and 29 where no formation or shearing of web 17 occurs.

Dies 19 and 20, lying across the width of web 17, impart rows of generally sinusoidal convolutions 16 down the length of the web and across its width. Because of the lack of web formation in the neutral zones, which are aligned across the width of dies 19 and 20, each complete convolution 16 is separated longitudinally from the next convolution 16 by a flat portion lying substantially in the original plane of web 17. Also, because each "A" or "C" die is located 180° out of phase from its abutting "B" or "D" die, alternate rows of convolutions 16 extend across the web width, each row lying 180° out of phase from the abutting rows.

Each individual die is preferably about 1 mm. wide and each die set 19 and 20 preferably comprises 20 such 1 mm. dies. Additionally, a die about 3 mm. wide is located at each lateral end of each die set. With this die arrangement, an expanded web 12 approximately 22 mm. wide can be formed without any feathering of the web edges which might result from commonly encountered lateral web drift as the web feeds through dies 19 and 20. Despite slight web drift, the outer 3 mm. dies are sufficiently wide so that the web edges will be uniformly sheared and formed.

Figure 7:
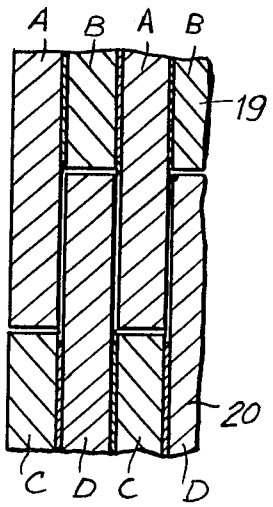
FIGS. 5–7 are sectional views of the dies of FIG. 4 taken along lines 5—5, 6—6, and 7—7, respectively.
Figure 6:
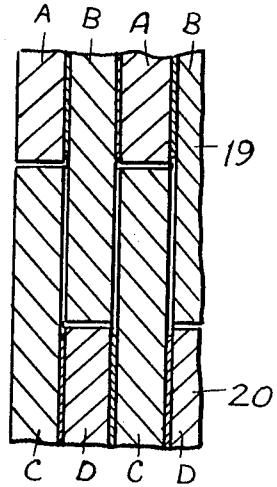
Figure 5:
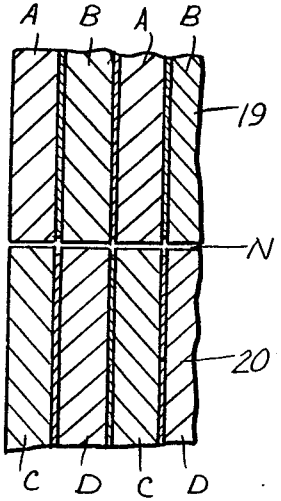

FIGS. 5–7 illustrate the cooperation of dies 19 and 20 during successive points in their rotation. When the flat sections 28 and 29 confront, they abut web 17 without acting on the web to shear or form it. As the dies rotate, tooth 30 of the "B" die forms web 17 downwardly while the next adjacent tooth on the "A" die forms web 17 upwardly, thus creating laterally adjacent half convolutions 180° out of phase. Further rotation of the dies reverses their respective roles and generates the other half convolutions before re-engagement of flat sections 28 and 29 in the neutral zone.

The thickness of the expanded web 12 is governed by the size of the die teeth. Preferably, the length of each die tooth, as defined, for example, by the distance from the bottom of recess 31 to the tip of tooth 32, is on the order of 1 mm. This dimension may be varied as desired to alter the thickness of expanded web 12.

In addition to the sheared and formed configuration imparted by dies 19 and 20, their lateral tooth edges shear web 17 along the lateral boundaries of convolutions 16 and so assist in generating the wave pattern. No shearing occurs in the neutral zone.

After web 17 is formed and sheared to make expanded web 12, the expanded web is fed through guides 21 to accumulator wheel 22, which is in nip relation to glue wheel 23. Glue wheel 23 transfers glue from glue pot 23' and applies glue line 24 to the centerline of the underside of web 12. Alternatively, glue wheel 23 may be situated to apply glue line 24 to the surface of web 25 feeding from bobbin 26.

Confronting webs 12 and 25 then pass through press rollers 27 where they are urged together along glue line 24. The nip between press rollers 27 should be sufficiently small to urge the webs together for a secure bond, but not so small as to permanently deform convolutions 16 in expanded web 12. Heat is preferably applied to assist in the setting of glue line 24. After the webs are secured together to complete composite web 10, the composite web may be fed directly into a conventional cigarette making machine for conversion into expanded wrappers 13.

Accumulator wheel 22, in addition to cooperating with glue wheel 23 to form a nip, also serves to meter expanded web onto web 25. Accumulator wheel 22 runs at substantially the same linear speed as web 25, while dies 19 and 20 may run at varying speeds. If the dies run slower than the linear speed of accumulator wheel 22 and web 25, the periodicity of convolutions 16 will be increased, giving an extended expanded web 130 (FIG.

Figure 11:
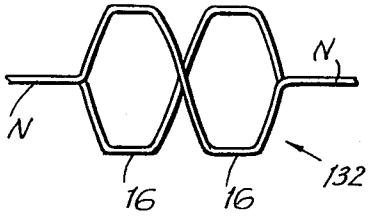
FIGS. 11–13 are side sectional views of the expanded web showing a normal, a condensed and an extended expanded web, respectively.
Figure 12:
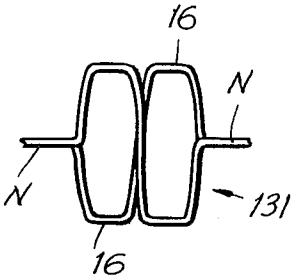
Figure 13:
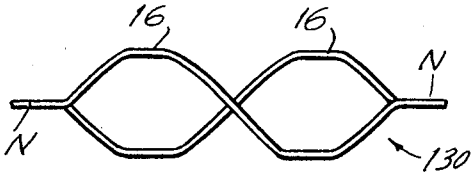
Figure 17:
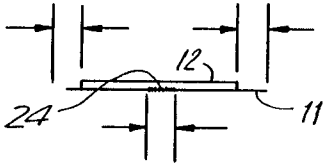
FIG. 17 is a schematic view of the expanded web showing the location of the glue line securing the laminates together.

13). Conversely, if dies 19 and 20 run faster than accumulator wheel 22 and web 25, the periodicity of the convolutions will be reduced, resulting in a condensed expanded web 131 (FIG. 12). And if dies 19 and 20, accumulator wheel 22, and web 25 all run at the same linear speed, a normal expanded web 132 will be formed (FIG. 11).

Rotary dies 19 and 20 may be driven in any known manner. Preferably, they are driven by a variable speed D.C. motor connected to their axles in known manner. Likewise, accumulator wheel 22 and glue wheel 23 are driven in conventional manner, as are rollers 27, which draw web 25 off of bobbin 26. Bobbins 18 and 26 are preferably mounted on free-wheeling axles.

The sheet material of web 17 preferably comprises a ductile cellulosic material with sufficient resiliency so that it will not tear at the extremity of each convolution 16 during forming by dies 19 and 20. It also should be sufficiently shearable that it will cut readily along the lateral boundaries of each convolution 16 during shearing by the scissoring edges of dies 19 and 20. The material should be strong enough to retain the expanded form imparted to it by the dies. Suitable material may be paper, reconstituted tobacco, flax paper, or mixtures thereof. The material should have a thickness corresponding to the clearance between dies 19 and 20, and that clearance is preferably on the order of 3 mils. Web 25 which forms the outer wrapper 11 in the expanded wrapper 13 is preferably conventional cigarette paper.

Figure 16:
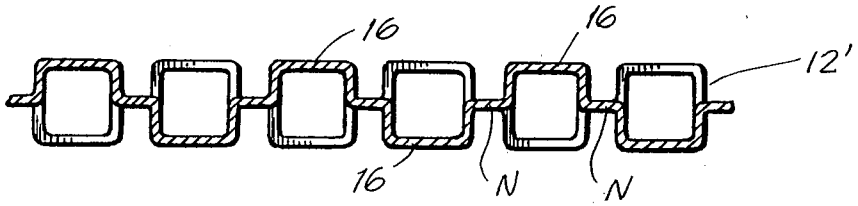
FIG. 16 is a side sectional view of the expanded web manufactured by an alternate embodiment of the dies of the apparatus.

An alternate configuration 12' of the expanded web is illustrated FIG. 16. This configuration is achieved by modifying the shape of the teeth of rotary dies 19 and 20. Any die configuration which imparts a generally sinusoidal configuration to the web may be used within the scope of the invention.

I claim:

1. Apparatus for manufacturing a composite web, comprising:

a. first feed means for supplying a first web of formable material to a set of rotating forming and shearing dies having meshing teeth and recesses, the die set further comprising a plurality of laterally-disposed pairs of dies, the teeth on each die lying 180° out of phase from the teeth on each horizontally adjacent die and each tooth of a die joined to the next recess on the die by a flat segment, the flat segments of the die set defining a neutral zone in which substantially no shearing or forming of the web occurs;

b. second feed means for supplying a second web of paper-like material for lamination to a surface of the first web after passage of the first web through the rotary dies; and c. drive means for rotating the set of rotary dies.

2. The apparatus of claim 1 in which the profile of the meshing teeth of a die between successive flat segments defines a generally sinusoidal curve.

3. The apparatus of claim 1 further comprising accumulator means for metering the first web onto the second web after passage of the first web through the rotary dies.

4. The apparatus of claim 3 further comprising sets of meshing rotary dies driveable at varying speeds.

5. Apparatus for manufacturing an expanded web, comprising feed means for delivering a web of formable sheet material to a forming means, the forming means comprising means for expanding the web by convoluting the web into a plurality of longitudinally extending rows of generally sinusoidal convolutions projecting alternately above and below the original plane of the web, the forming means including segments defining a neutral zone in which substantially no shearing or forming of the web occurs such that each convolution in a row is joined to the next longitudinally succeeding convolution by a web portion lying substantially in the original plane of the web.

6. The apparatus of claim 5 in which the forming means further comprises means for generating longitudinally extending rows of convolutions, each row of convolutions lying 180° out of phase from adjacent rows.

7. The apparatus of claim 5 in which the forming means comprises a set of meshing rotary forming and shearing dies.

8. The apparatus of claim 5 further comprising means for providing a second web of sheet material and means for laminating the second web to a surface of the expanded web.

9. The apparatus of claim 8 further comprising means for varying the periodicity of the generally sinusoidal convolutions formed in the expanded web.

* * * * *